US009732448B2

(12) United States Patent
Liu

(10) Patent No.: US 9,732,448 B2
(45) Date of Patent: Aug. 15, 2017

(54) SEAMLESS FILLING WOVEN TAPE UNIT, YARN TANK TRANSPORTATION EQUIPMENT AND FILLING PROCESS THEREOF

(71) Applicant: POLYUNION TEXTILE (SHENZHEN) FACTORY, Shenzhen (CN)

(72) Inventor: Lu Liu, Shenzhen (CN)

(73) Assignee: POLYUNION TEXTILE (SHENZHEN) FACTORY, Guangdong (CN)

( * ) Notice: Subject to any disclaimer, the term of this patent is extended or adjusted under 35 U.S.C. 154(b) by 0 days.

(21) Appl. No.: 15/028,552

(22) PCT Filed: Oct. 11, 2013

(86) PCT No.: PCT/CN2013/085073
§ 371 (c)(1),
(2) Date: Aug. 30, 2016

(87) PCT Pub. No.: WO2015/051542
PCT Pub. Date: Apr. 16, 2015

(65) Prior Publication Data
US 2016/0362821 A1 Dec. 15, 2016

(51) Int. Cl.

| | |
|---|---|
| ***D03D 3/02*** | (2006.01) |
| ***B68G 7/06*** | (2006.01) |
| ***D04D 9/00*** | (2006.01) |
| *D03D 25/00* | (2006.01) |

(52) U.S. Cl.
CPC ..... *D03D 3/02* (2013.01); *B68G 7/06* (2013.01); *D04D 9/00* (2013.01)

(58) Field of Classification Search
CPC ..... D03D 15/08; D03D 3/005; D03D 1/0005; D03D 3/02; D03D 41/00; D03D 15/0027; B32B 1/08
See application file for complete search history.

(56) References Cited

U.S. PATENT DOCUMENTS

| | | | | |
|---|---|---|---|---|
| 9,080,265 | B2 * | 7/2015 | He | D03D 5/00 |
| 2005/0239360 | A1 * | 10/2005 | Lam | D02G 3/322 442/197 |
| 2014/0174586 | A1 * | 6/2014 | He | D03D 5/00 139/421 |

(Continued)

*Primary Examiner* — Bobby Muromoto, Jr.
(74) *Attorney, Agent, or Firm* — McDonald Hopkins LLC

(57) ABSTRACT

A seamless filling woven tape unit, a yarn tank transportation equipment and the filling process thereof. The woven tape unit utilizes a woven tape and a filler arranged in the woven tape, wherein the woven tape utilizes several woven tape units formed by integrated weaving, the woven tape unit utilizes a hollow woven tape and a solid woven tape formed by integrally weaving the two ends of the hollow tape, and a cavity of the hollow woven tape is uniformly filled with a flexible filler injected through fiber injection equipment. The flexible filler is injected into the woven tapes by fiber injection equipment so elasticity of the woven tape is guaranteed. Since the flexible filler is directly injected into the cavity of the hollow woven tape through a pin-shaped thin pipe arranged on the fiber injection equipment, the woven tapes do not need to be sewn.

9 Claims, 3 Drawing Sheets

(56) References Cited

U.S. PATENT DOCUMENTS

| | | | | |
|---|---|---|---|---|
| 2015/0176161 | A1* | 6/2015 | Chiu | A63B 29/02<br>139/387 R |
| 2016/0175625 | A1* | 6/2016 | Chui | A62B 35/0025<br>182/3 |

* cited by examiner

SEAMLESS FILLING WOVEN TAPE UNIT, YARN TANK TRANSPORTATION EQUIPMENT AND FILLING PROCESS THEREOF

CROSS REFERENCE TO RELATED APPLICATIONS

This application is a 35 U.S.C. 371 national stage filing and claims priority to International Application No. PCT/CN2013/085073 filed on Oct. 11, 2013, entitled "SEAMLESS FILLING WOVEN TAPE UNIT, YARN TANK TRANSPORTATION EQUIPMENT AND FILLING PROCESS THEREOF," which is incorporated herein in its entirety by reference.

TECHNICAL FIELD

The present disclosure relates to the field of textile technique, and in particular to a seamless filling woven tape unit, a yarn tank transportation equipment and filling process thereof.

BACKGROUND

Woven tapes, as a type of textile, have been widely used in the textile industry and even daily life. In particular, it is widely used in a variety of fields such as outdoor articles, bag industry, shipping, high-altitude industry or the like. The woven tapes in the prior art are generally made either by first laminating a filler on the woven tape and then sewing them integrally through stitching, or by opening a filling port in a cavity of a hollow woven tape, then filling the filler through the filling port and thereafter sewing the filling port through stitching. The above-mentioned filling approaches for the woven tapes have disadvantages in that the fabrication process is troublesome relatively, there are seams or stitching tracks on a surface of the woven tape, elasticity of the woven tape sewn by the stitching is reduced and both the comfort level during use and effect of appearance of the products are reduced as well. Hence, making the process simpler, the appearance more appealing, and the use process more comfortable while guaranteeing elasticity and softness of the woven tapes by means of seamless filling become a problem to be solved.

SUMMARY

An object of the present disclosure is to provide a seamless filling woven tape and process thereof which is simpler in technique, can save labor and material resources, and has a better effect of filling without stitching tracks.

To this end, the present disclosure adopts the solution as follows.

A seamless filling woven unit includes a woven tape and a filler arranged within the woven tape. The woven tape include several woven tape units that are woven integrally, wherein the woven tape units includes a hollow woven tape and a solid woven tape that is integrally woven with two ends of the hollow woven tape. A flexible filler injected through a fiber injection device is uniformly filled within a cavity of the hollow woven tape.

Wherein the flexible filler is flexible yarns injected through the fiber injection device.

Where the fiber injection device is a yarn tank transportation device that injects the flexible yarn into the hollow woven tape through a pin-shaped thin pipe by using air pressure.

Where the hollow woven tape is configured as a tubular monolayer structure with two ends closed.

Where the solid woven tape is configured as a belt-shaped double-layer structure.

A yarn tank transportation device for the seamless filling woven unit is provided. The yarn tank transportation device is provided with a cavity connected to a gas tube, where one end of the cavity is provided with a thick yarn outlet connected to the pin-shaped thin pipe, and the other end thereof is provided with a thin yarn inlet for passing the yarn therethrough. The gas tube has a treadle type switch thereon for controlling air stream in and out.

Where the yarn tank transportation device is fixed to a working table by a metal hoop.

A filling process for the seamless filling woven unit includes the steps of:

S1: weaving a woven tape including several continuous woven tape units that are integrally woven by means of a weaving machine;

S2: making a hot cutting machine align with a cutting line on the solid woven tape so that the woven tape is cut into a plurality of the woven tape units;

S3: threading an end of the yarn on the spindle into the yarn tank transportation equipment and inserting the pin-shaped thin pipe that is disposed at one end of the yarn tank transportation equipment into one end of a cavity of the hollow woven tape;

S4: turning on the switch to control two sides of the hollow woven tape so that a certain amount of yarns are uniformly injected into the cavity of the hollow woven tape by means of the yarn tank transportation equipment; and S5: after the cavity of the hollow woven tape is fully filled with the yarns, turning off the switch, cutting off the yarns, and pulling out the pin-shaped thin pipe.

Where the woven tape unit before filling is a flat woven tape unit that is integrally woven.

The advantageous effects of the present disclosure lie in that the present disclosure includes a woven tape and a filler arranged in the woven tape, where the woven tape includes several woven units that are integrally woven, the woven tape unit includes a hollow woven tape and a solid woven tape that is integrally woven with two ends of the hollow woven tape, and the flexible filler injected by a fiber injection device is uniformly filled within the cavity of the hollow woven tape. The woven tape having the flexible filler injected by the fiber injection device is guaranteed with elasticity, and meanwhile the filling process becomes simpler, which greatly saves labor and material resources. At the same time, because the flexible filler is directly injected into the cavity of the hollow woven tape by a pin-shaped thin pipe disposed in the fiber injection device, the woven tapes do not need to be sewn and do not have stitching tracks. Therefore, the present disclosure has a simpler process, can save labor and material resources, and has a better filling effect without any stitching tracks.

REFERENCE NUMBER LIST

1: hollow woven tape; 2: solid woven tape; 3: woven tape unit; 4: flexible yarn; 5: yarn tank transportation device; 6: gas tube; 7: cavity; 8: pin-shaped thin pipe; 9: yarn outlet; 10: yarn inlet; 11: treadle type switch.

DETAILED DESCRIPTION

Figure 1:
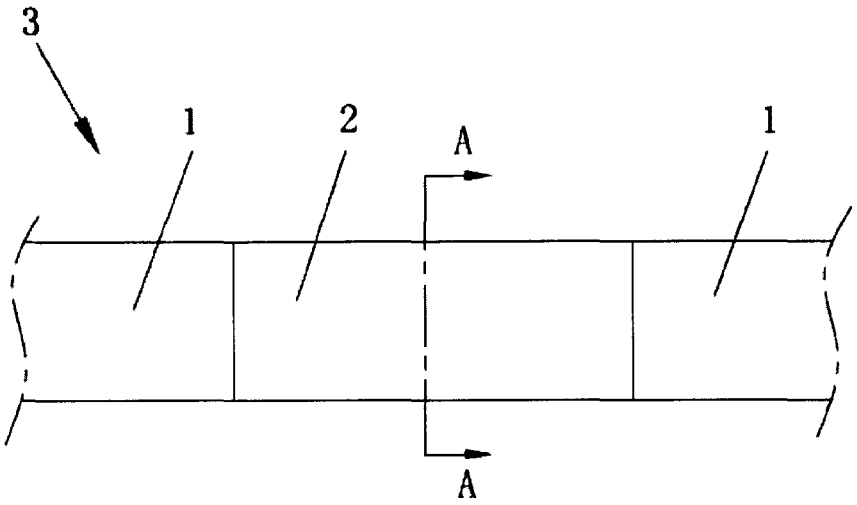
FIG. 1 is a structural schematic view illustrating a seamless filling woven tape unit according to the present disclosure.
Figure 2:
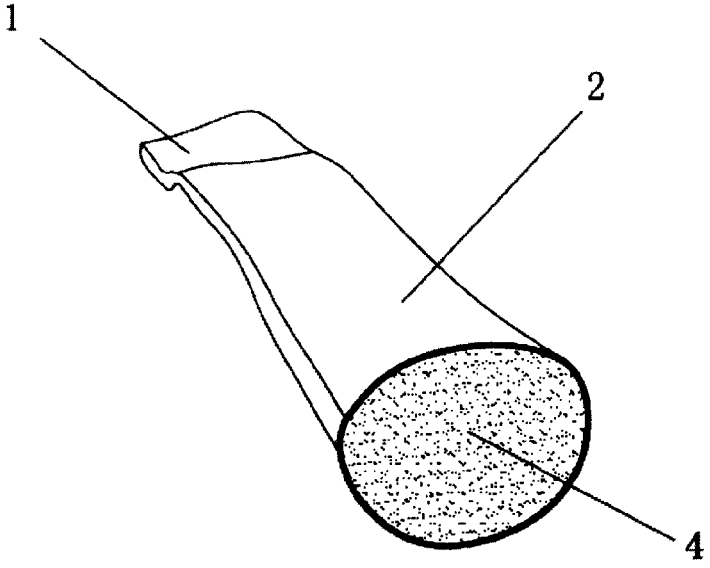
FIG. 2 is an axial side view taken along A-A in FIG. 1.
Figure 3:
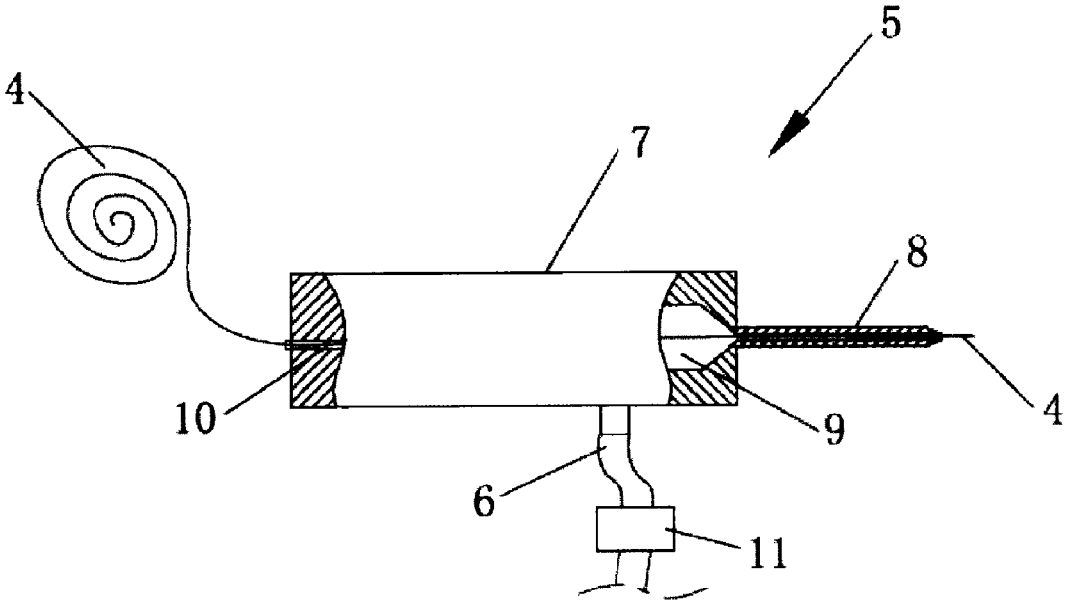
FIG. 3 is a structural schematic view illustrating a yarn tank transportation device.
Figure 4:
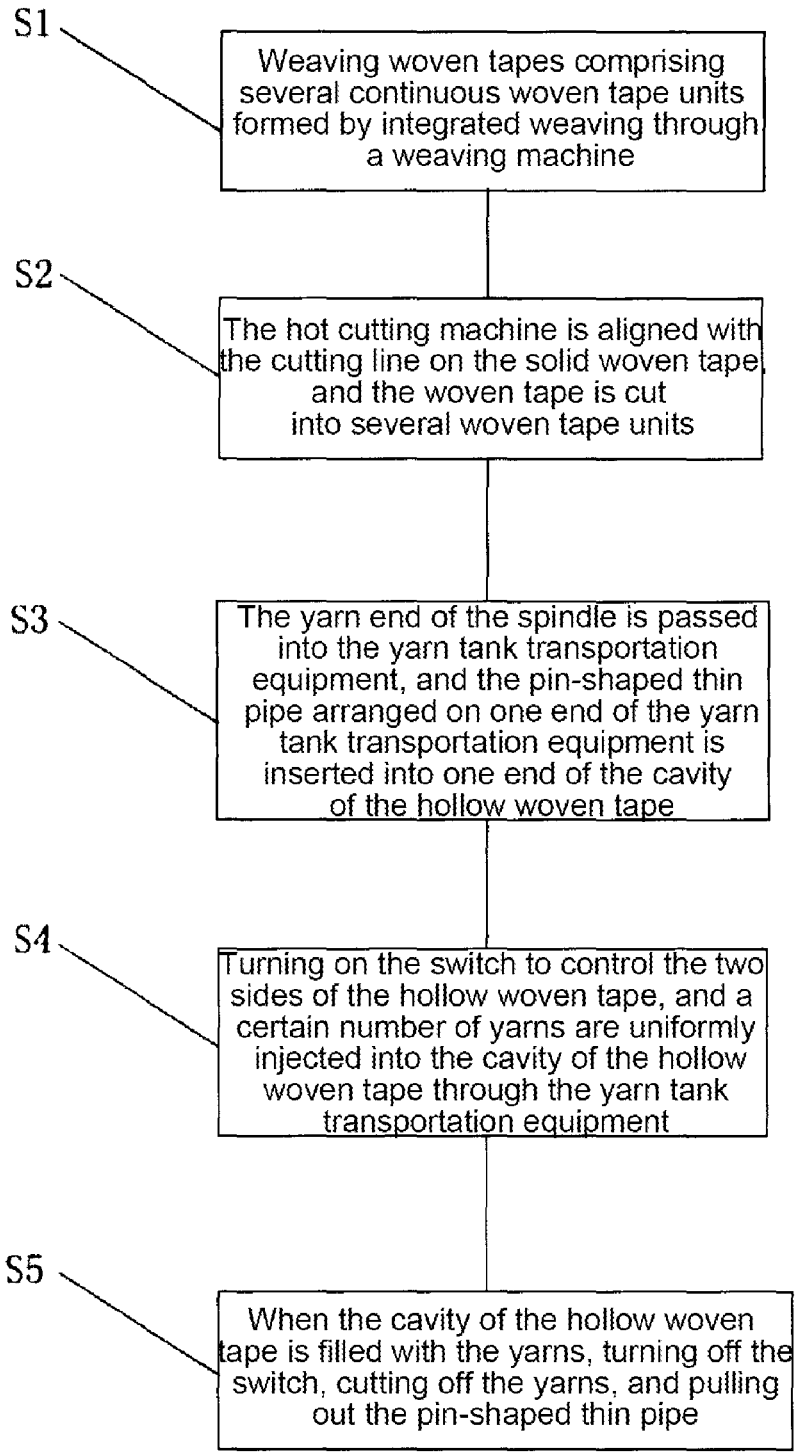
FIG. 4 is a flowchart illustrating a filling process of the seamless filling woven tape unit according to the present disclosure.

Hereinafter, the technical solution of the present disclosure will be further described from the description in detail with reference to the FIGS. 1-4.

A seamless filling woven tape unit may include a woven tape and a filler arranged within the woven tape. The woven tape includes several woven tape unit 3 that are integrally woven, and the woven tape unit 3 may include a hollow woven tape 2 and a solid filler 1 that is integrally woven with two ends of the hollow woven tape 2. A flexible filler that is injected by a fiber injection device is uniformly filled within a cavity of the hollow woven tape 2. The woven tape having the flexible filler injected by the fiber injection device is guaranteed with elasticity, and meanwhile the filling process becomes simpler, which greatly saves labor and material resources. At the same time, because the flexible filler is directly injected into the cavity of the hollow woven tape by a pin-shaped thin pipe disposed in the fiber injection device, the woven tapes do not need to be sewn and do not have stitching tracks. Therefore, the present disclosure has simpler process, can save labor and material resources and has a better filling effect without any stitching tracks.

The flexible filler is flexible yarns 4 injected by the fiber injection device or other alternatives similar to the flexible yarns. The thickness of the flexible yarns may be randomly adjusted depending on the fiber injection device.

The fiber injection device is a yarn tank transportation device 5 that injects the flexible yarn 4 into the hollow woven tape 2 through a pin-shaped thin pipe 8 by using air pressure. By virtue of the blowing of air and the air pressure generated, the yarns are injected into the cavity of the hollow woven tape by the yarn tank transportation device 5 so as to fill the cavity of the hollow woven tape.

The hollow woven tape 2 is configured as a tubular monolayer structure with two ends closed.

The solid woven tape 1 is configured as a belt-shaped double layer structure.

A yarn tank transportation device for the seamless filling woven unit is provided. The yarn tank transportation device 5 is provided with a cavity 7 connected to a gas tube 6, one end of the cavity 7 is provided with a thick yarn outlet 9 connected to the pin-shaped thin pipe 8, and the other end thereof is provided with a thin yarn inlet 10 for passing the yarn therethrough. The gas tube 6 has a treadle type switch 11 thereon for controlling air stream in and out. One end of the flexible yarns is threaded into an end of the pin-shaped thin pipe from the yarn inlet. Because a thicker yarn outlet is provided at a yarn outlet end of the cavity, the gas accumulated within the cavity will be predominantly blown out from the thicker yarn outlet end. The gas stream generated during such a process may move the flexible yarns toward direction of the pin-shaped thin pipe at the yarn outlet end, such that the flexible yarns are input into the cavity of the hollow woven tape from the spindle constantly. In addition, due to denser wall of the cavity of the hollow woven tape, the air blown out along the pin-shaped thin pipe can temporarily inflate the cavity of the hollow woven tape, which will provide space for injection of the flexible yarns.

The yarn tank transportation device 5 is fixed to a working table by a metal hoop.

The woven tape and the pin-shaped thin pipe are maintained in horizontal, thereby facilitating the injection of the yarns.

A filling process of the seamless filling woven tape unit may include the steps of:

S1: weaving a woven tape including several continuous woven tape units 3 that are integrally woven by means of a weaving machine;

S2: making a hot cutting machine align with a cutting line on the solid woven tape 1 so that the woven tape is cut into a plurality of the woven tape units 3;

S3: threading an end of the yarn on the spindle into the yarn tank transportation equipment 5 and inserting the pin-shaped thin pipe 8 that is disposed at an end of the yarn tank transportation equipment 5 into an end of a cavity of the hollow woven tape 2;

S4: turning on the switch to control two sides of the hollow woven tape 2 so that a certain amount of yarns are uniformly injected into the cavity of the hollow woven tape 2 by means of the yarn tank transportation equipment 5; and S5: after the cavity of the hollow woven tape 2 is fully filled with the yarns, turning off the switch, cutting off the yarns, and pulling out the pin-shaped thin pipe 8.

According to embodiments of the present disclosure, the woven tape before filling is a flat unit that is integrally woven having length of 1000 mm, which includes two woven tape units having length of 500 mm. Each of woven tape units may include two segments of solid woven tapes having length of 100 mm at two ends of the hollow woven tape unit respectively. A cutting line in the solid woven tape is targeted by a hot cutting machine, such that the solid woven tape is divided into two woven tape units. Thereafter, a pin-shaped circular pipe can be inserted into one end of the hollow woven tape. At this time, a mounted treadle type switch of the yarn tank transportation device is stepped down so as to be turned on. Two sides of the hollow woven tape may be grasped by two hands of an operator so that the yarns are constantly blown into the cavity of the hollow woven tape through gas streams. It is noted that the position of the woven tape is to be adjusted constantly and the surface layer of the hollow woven tape is pressed against by fingers of the operator to achieve filling as uniformly as possible. After filling of a certain amount of the flexible yarns are completed, the treadle type switch is stepped down by foot of the operator again so as to close the gas tube and to stop injecting yarns. Thus, the pin-shaped thin pipe may be pulled out to cut off the yarns, thereby completing the entire process of yarns injection.

The technical principle of the present disclosure is described in connection with the embodiments of the present disclosure above. Such descriptions are merely used to explain the principle of the present disclosure, and should not be construed as limiting the scope of the present disclosure in any way. Based on the explanation herein, those skilled in the art will conceive other embodiments of the present disclosure without any creative work, and all such embodiments should fall within the protection scope of the present disclosure.

The invention claimed is:

1. A seamless filling woven unit, comprising a woven tape and a filler arranged within the woven tape, wherein the woven tape comprises several woven tape units (3) that are woven integrally, the woven tape units (3) comprise a hollow woven tape (2) and a solid woven tape (1), the solid woven tape (1) is integrally woven with two ends of the hollow woven tape (2), a flexible filler injected through a fiber injection device is uniformly filled within a cavity of the hollow woven tape (2).

2. The seamless filling woven unit of claim 1, wherein the flexible filler is flexible yarns (4) injected through the fiber injection device.

3. The seamless filling woven unit of claim 2, wherein the fiber injection device is a yarn tank transportation device (5) that injects the flexible yarns (4) into the hollow woven tape (2) through a pin-shaped thin pipe (8) by using air pressure.

4. The seamless filling woven unit of claim 2, wherein the hollow woven tape (2) is configured as a tubular monolayer structure with two ends closed.

5. The seamless filling woven unit of claim 1, wherein the solid woven tape (1) is configured as a belt-shaped double-layer structure.

6. A yarn tank transportation device for filling the seamless filling woven unit of claim 3, wherein the yarn tank transportation device (5) is provided with a cavity (7) connected to a gas tube (6), one end of the cavity (7) is provided with a thick yarn outlet (9) connected to the pin-shaped thin pipe (8), and the other end thereof is provided with a thin yarn inlet (10) for passing the yarn therethrough, the gas tube (6) has a treadle type switch (11) thereon for controlling air stream in and out.

7. The yarn tank transportation device of claim 6, wherein the yarn tank transportation device (5) is fixed to a working table by a metal hoop.

8. A filling process for the seamless filling woven unit of claim 3, comprising the steps of:

S1: weaving a woven tape comprising several continuous woven tape units (3) that are integrally woven by means of a weaving machine;

S2: making a hot cutting machine align with a cutting line on the solid woven tape (1) so that the woven tape is cut into a plurality of the woven tape units (3);

S3: threading an end of the yarn on the spindle into the yarn tank transportation equipment (5) and inserting the pin-shaped thin pipe (8) that is disposed at one end of the yarn tank transportation equipment (5) into one end of a cavity of the hollow woven tape (2);

S4: turning on the switch to control two sides of the hollow woven tape (2) so that a certain amount of yarns are uniformly injected into the cavity of the hollow woven tape (2) by means of the yarn tank transportation equipment (5); and S5: after the cavity of the hollow woven tape (2) is fully filled with the yarns, turning off the switch, cutting off the yarns, and pulling out the pin-shaped thin pipe (8).

9. The filling process of claim 8, wherein the woven tape unit (3) before filling is a flat woven tape unit that is integrally woven.

* * * * *